US011420439B2

(12) United States Patent
Katayama et al.

(10) Patent No.: US 11,420,439 B2
(45) Date of Patent: Aug. 23, 2022

(54) LIQUID DISCHARGE HEAD

(71) Applicant: Brother Kogyo Kabushiki Kaisha, Aichi-Ken (JP)

(72) Inventors: Shingo Katayama, Nisshin (JP); Toru Kakiuchi, Chita-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/237,703

(22) Filed: Apr. 22, 2021

(65) Prior Publication Data

US 2021/0331472 A1 Oct. 28, 2021

(30) Foreign Application Priority Data

Apr. 22, 2020 (JP) ..... JP2020-076237

(51) Int. Cl.
*B41J 2/14* (2006.01)
*B41J 2/175* (2006.01)

(52) U.S. Cl.
CPC ..... *B41J 2/14201* (2013.01); *B41J 2/17596* (2013.01); *B41J 2002/14419* (2013.01)

(58) Field of Classification Search
CPC ..... B41J 2/14201; B41J 2/17596; B41J 2002/14419; B41J 2002/14491; B41J 2002/14241
See application file for complete search history.

(56) References Cited

U.S. PATENT DOCUMENTS 9,061,532 B2 * 6/2015 Nodsu ..... B41J 2/04563
9,878,539 B2 * 1/2018 Hayashi ..... B41J 2/055
11,267,244 B2 * 3/2022 Kishigami ..... B41J 2/18
2002/0163562 A1 11/2002 Tanaka et al.

FOREIGN PATENT DOCUMENTS

JP 2008-012819 A 1/2008
JP 2012-200948 A 10/2012

OTHER PUBLICATIONS

Sep. 23, 2021—(EP) Extended Search Report—App 21169283.5.

* cited by examiner

*Primary Examiner* — An H Do
(74) *Attorney, Agent, or Firm* — Banner & Witcoff, Ltd.

(57) ABSTRACT

There is provided a liquid discharge head, including: a plurality of inlet parts provided corresponding to a plurality of kinds of liquids; a plurality of pressure chambers in which discharge pressure is applied to the liquids; a plurality of individual outlet parts through which the liquids are supplied to the plurality of pressure chambers; and a manifold which communicates with the plurality of inlet parts, and through which the liquids from the plurality of inlet parts are supplied to the plurality of individual outlet parts. The manifold includes: a plurality of upstream-side portions in each of which a channel corresponding to one of the plurality of inlet parts is defined, and a downstream-side portion which communicates with the plurality of upstream-side portions, and in which a channel communicating with the plurality of individual outlet parts is defined.

19 Claims, 6 Drawing Sheets

LIQUID DISCHARGE HEAD

CROSS REFERENCE TO RELATED APPLICATION

The present application claims priority from Japanese Patent Application No. 2020-076237, filed on Apr. 22, 2020, the disclosure of which is incorporated herein by reference in its entirety.

BACKGROUND

The present disclosure is related to a liquid discharge head configured to discharge or eject a liquid such as ink.

A liquid discharge head that discharges ink is provided in an image recording apparatus such as an ink-jet printer. For example, Japanese Patent Application Laid-open No. 2008-012819 discloses the following configuration. A three-port valve (a valve having a cleaner inlet port, an ink inlet port, and an ink outlet port) is inserted into circulation channels connected to the liquid discharge head. The ink or the cleaner is supplied to the liquid discharge head by switching the port as needed. Accordingly, the interior of the liquid discharge head is cleaned with the cleaner. Japanese Patent Application Laid-open No. 2012-200948 discloses a configuration in which the supply of different kinds of inks is switched in a supply channel positioned upstream of a reservoir in the liquid discharge head. In this configuration, the multiple kinds of inks can be discharged or ejected from one liquid discharge head.

SUMMARY

An object of the present disclosure is to provide a liquid discharge head capable of discharging multiple kinds of liquids quickly without an increase in size of the liquid discharge head.

A liquid discharge head according to an aspect of the disclosure includes:

- a plurality of inlet parts provided corresponding to a plurality of kinds of liquids;
- a plurality of pressure chambers in which discharge pressure is applied to the liquids;
- a plurality of individual outlet parts through which the liquids are supplied to the plurality of pressure chambers; and
- a manifold which communicates with the plurality of inlet parts, and through which the liquids from the plurality of inlet parts are supplied to the plurality of individual outlet parts, wherein the manifold includes:

- a plurality of upstream-side portions in each of which a channel corresponding to one of the plurality of inlet parts is defined, and
- a downstream-side portion which communicates with the plurality of upstream-side portions, and in which a channel communicating with the plurality of individual outlet parts is defined.

DESCRIPTION OF THE EMBODIMENTS

Figure 1:
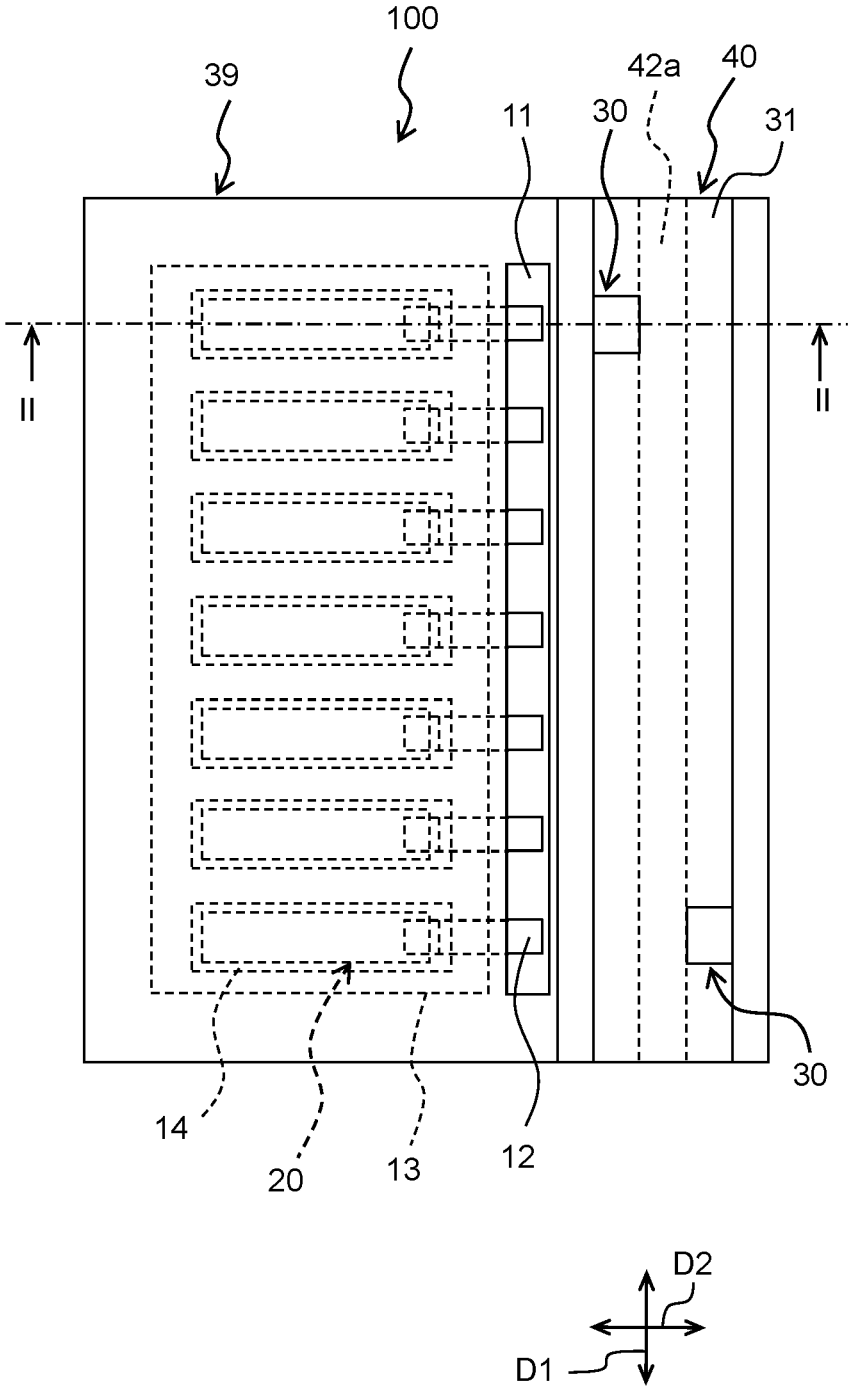
FIG. 1 is a plan view of a liquid discharge head according to an embodiment of the present disclosure.

The liquid discharge head in Japanese Patent Application Laid-open No. 2008-012819 does not disclose any configuration for switching the supply of different inks (e.g., pigment and dye). Thus, multiple liquid discharge heads are required to be provided when different kinds of inks are discharged. This increases the number of parts or components of the liquid discharge head, resulting in an increase in size of the liquid discharge apparatus. As for the configuration in Japanese Patent Application Laid-open No. 2012-200948 in which liquid supply is switched in the supply channel of the liquid discharge head, ink remaining in all the channels (the supply channel, the reservoir, and individual channels) is drained (discharged) and then another ink is introduced into the liquid discharge apparatus. This takes a long time. Further, a lump of ink may remain in an O ring or the like provided in the supply channel, which may cause color mixture.

According to the present disclosure, the manifold is formed by the upstream-side portions corresponding to the inlet parts and the downstream-side portion that is common to the upstream-side portions. Thus, there is no need to provide a plurality of liquid discharge heads. This prevents an increase in size of the apparatus or device. Further, there is no need to provide a switching mechanism such as a three-port valve, and thus it is possible to downsize a configuration for switching liquid supply. In a conventional apparatus, a preceding ink remaining in long channels that include a supply channel, a reservoir, and individual channels is required to be drained (discharged) before following ink is introduced into the apparatus. In the liquid discharge head of the present disclosure, the switching of liquid supply can be performed at a side more downstream than the conventional configuration. Thus, a time required for draining (discharging) the preceding liquid remaining in the channels can be shortened, and the following liquid can be introduced into the downstream-side portion of the manifold through the inlet part corresponding thereto immediately after the preceding liquid remaining in the channels is discharged. Accordingly, multiple kinds of liquids can be discharged quickly. Further, the switching of liquid supply can be performed at the upstream-side portions of the manifold, and thus the liquid channels can be shorter than those in the conventional apparatus. This makes an amount of the residual liquid smaller than that in the conventional apparatus. Accordingly, it is possible to make an area where liquids are mixed (color mixture area) small and to reduce a drain amount (discharge amount) of the liquid.

According to the present disclosure, it is possible to provide a liquid discharge head capable of discharging multiple kinds of liquids quickly without an increase in size of the liquid discharge head.

Referring to the drawings, a liquid discharge head according to an embodiment of the present invention is explained below. The liquid discharge head described below is merely an embodiment of the present invention. Thus, the present invention is not limited to the following embodiment. It is possible to make addition, deletion, and modification within a range without deviating from the gist or essential characteristics of the present invention.

First Embodiment

<Schematic Configuration of Liquid Discharge Head>

In the respective drawings, D1 indicates a front-rear direction (arrangement direction), D2 indicates a left-right direction (axis direction) orthogonal to the front-rear direction D1, and D3 indicates an up-down direction orthogonal to the front-rear direction D1 and the left-right direction D2.

Liquids discharged or ejected from a liquid discharge head 100 according to an embodiment of the present disclosure include, for example, a pigment (pigment ink), a dye (dye ink), a pre-treatment agent, and a post-treatment agent. The pre-treatment agent is used to improve fixing properties of liquid (ink), and the post-treatment agent is used to improve wear resistance.

Figure 2:
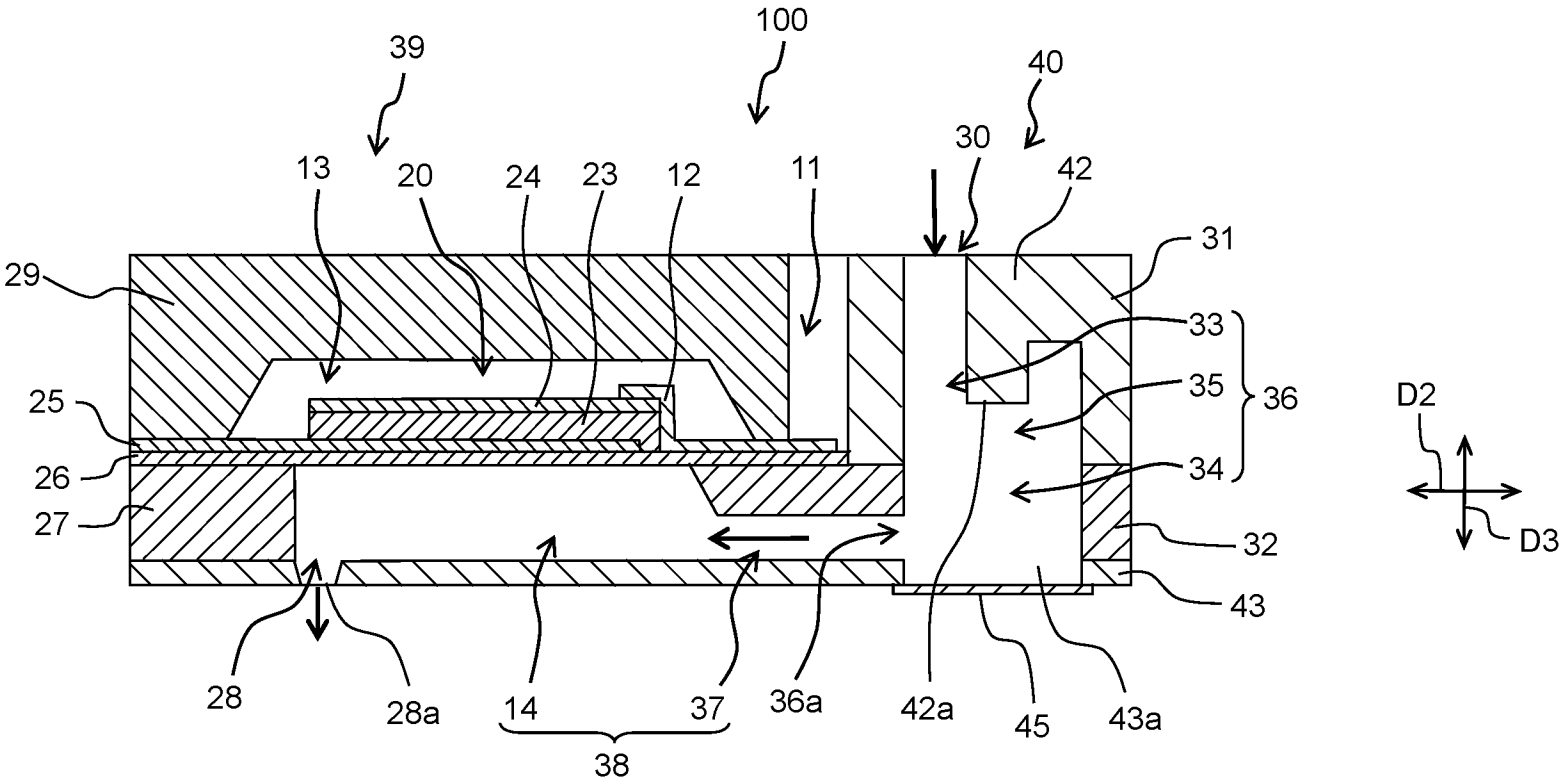
FIG. 2 is a cross-sectional view taken along a line II-II in FIG. 1.

As depicted in FIGS. 1 and 2, the liquid discharge head 100 of this embodiment is formed by a pressure chamber-side portion 39 and a manifold-side portion 40 when separated in the left-right direction D2. The manifold-side portion 40 is disposed at the right side of the pressure chamber-side portion 39 in FIGS. 1 and 2.

The pressure chamber-side portion 39 includes lead electrodes 12, piezoelectric elements 20 provided corresponding to nozzles 28 described below, an elastic film 26, a channel forming substrate 27, and a protective substrate 29. The channel forming substrate 27 is also used in the manifold-side portion 40. Details of the manifold-side portion 40 are described below. Each piezoelectric element 20 includes a piezoelectric body layer 23, an upper electrode film 24, and a lower electrode film 25.

In the following, details of a configuration of the pressure chamber-side portion 39 are explained first. Then, details of a configuration of the manifold-side portion 40 are explained.

The protective substrate 29 is formed, for example, by silicon. The protective substrate 29 has, for example, an inverted U-shape (inverted concave shape). This provides an arrangement space 13 for arranging the piezoelectric elements 20 at the lower side of the protective substrate 29. The piezoelectric elements 20 are arranged in the arrangement space 13.

The elastic film 26 is provided between the protective substrate 29 and a portion that is included in the channel forming substrate 27 and that forms the pressure chamber-side portion 39. The elastic film 26 is formed, for example, from silicon dioxide. The elastic film 26 has a thickness of 1 to 2 μm. The lower electrode film 25, the piezoelectric body layers 23, and the upper electrode film 24 are formed and stacked on the elastic film 26. In this embodiment, the lower electrode film 25 functions as a common electrode of the piezoelectric element 20, and the upper electrode film 24 functions as individual electrode of the piezoelectric element 20. However, is not limited thereto. The lower electrode film 25 may be formed to function as the individual electrode and the upper electrode film 24 may be formed to function as the common electrode depending on the convenience of wiring or the like. Further, the elastic film 26 and the lower electrode film 25 function as a vibration plate.

An area at the right side of the protective substrate 29 is a space 11. The lead electrodes 12 are formed, for example, from gold. A first end of the lead electrode 12 is connected to the upper electrode film 24 of the corresponding piezoelectric element 20. A second end of the lead electrode 12 is disposed at the lower side of the space 11.

The channel forming substrate 27 is formed, for example, from a silicon single crystal substrate. A nozzle plate 43 is stacked on a lower surface of the channel forming substrate 27. The nozzle plate 43 extends over the pressure chamber-side portion 39 and the manifold-side portion 40. A portion that is included in the channel forming substrate 27 and that forms the pressure chamber-side portion 39 is provided with liquid supply channels 37 communicating with respective individual outlet parts 36*a* of a downstream-side part 32 described below, pressure chambers 14, and the nozzles 28. The liquid supply channel 37 and the pressure chamber 14 form the individual channel 38. The individual outlet parts 36*a* of the downstream-side part 32 described below are connected to inlets of the respective liquid supply channels 37. Outlets of the liquid supply channels 37 communicate with the respective pressure chambers 14. The nozzles 28 are formed in the nozzle plate 43. Upstream ends of the nozzles 28 communicate with the respective pressure chambers 14, and downstream ends thereof are nozzle holes 28*a*.

Subsequently, details of the configuration of the manifold-side portion 40 in the liquid discharge head 100 are explained. The manifold-side portion 40 includes an upstream-side part (upstream-side structure) 31 and the downstream-side part (downstream-side structure) 32 that form a liquid channel, and a manifold partitioning wall 42. The downstream-side part 32 is a portion that is included in the channel forming substrate 27 and that forms the manifold-side portion 40.

The upstream-side part 31 is formed to have substantially a cylindrical shape by injection molding, for example. The downstream-side part 32 is formed to have substantially a cylindrical shape by wet etching, for example. Accordingly, the upstream-side portions 33 are formed, as space areas, in the upstream-side part 31, and the downstream-side portion 34 is formed, as a space area, in the downstream-side part 32. The downstream-side part 32 is joined to the upstream-side part 31. The upstream-side part 31 and the downstream-side part 32 are thus formed integrally. A lower end surface of the upstream-side part 31 is flush with a lower surface of the elastic film 26. An upper end surface of the downstream-side part 32 is flush with an upper surface of the channel forming substrate 27. The upstream-side part 31 is formed, for example, from resin. The upstream-side portions 33, the downstream-side portion 34, and a communication portion 35 described below form a manifold 36.

Figure 3A:
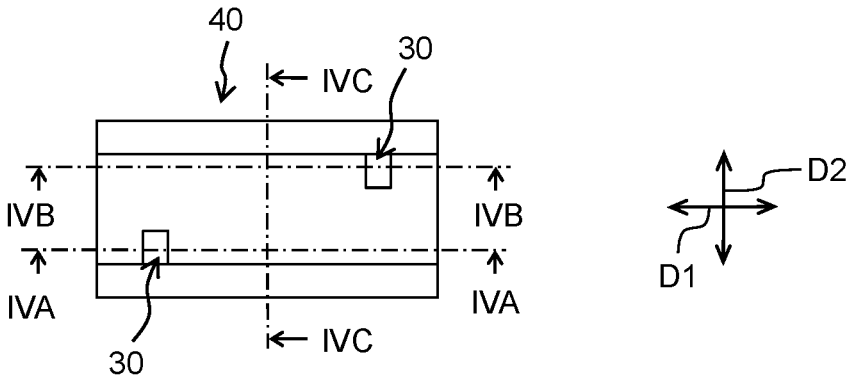
FIG. 3A is a plan view of a manifold-side portion in FIG. 2.

In this embodiment, as depicted in FIG. 3A, two inlet parts 30 are provided in an upper surface of the upstream-side part 31. The inlet parts 30 are arranged to be shifted from each other in the front-rear direction D1 (a direction in which the individual outlet parts 36*a* described below are arranged). Further, the inlet parts 30 are arranged to be shifted from each other in the left-right direction D2 orthogonal to the front-rear direction D1. That is, one of the inlet parts 30 is disposed at a predefined interval in the front-rear direction D1 from the other of the inlet parts 30. Further, one of the inlet parts 30 is disposed at a predefined interval in the left-right direction D2 from the other of the inlet parts 30.

Figure 3B:
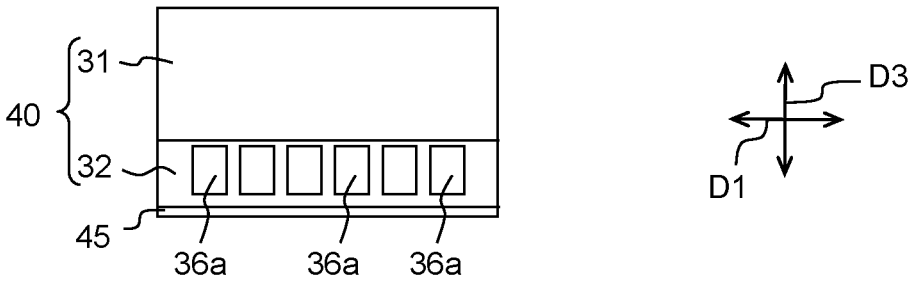
FIG. 3B is a side view of the manifold-side portion in FIG. 3A.

As depicted in FIG. 3B, the individual outlet parts 36*a* are provided in the downstream-side part 32 of the manifold-side portion 40. Specifically, the individual outlet parts 36*a* are provided in a side surface of the downstream-side part 32 at one side in a short-side or lateral direction (i.e., left-right direction D2) of the manifold 36. That is, the individual outlet parts 36*a* are arranged in the front-rear direction D1.

The respective inlet parts 30 are provided corresponding to multiple kinds of liquids. Specifically, for example, the pigment as the liquid inflows into one of the inlet parts 30 and the dye as the liquid inflows into the other of the inlet parts 30. More specifically, the pigment as the liquid inflows into the inlet part 30 (inlet part 30 at the lower side in FIG. 3A) included in the inlet parts 30 and closer to the individual outlet parts 36*a*. The dye as the liquid inflows into the inlet part 30 (inlet part 30 at the upper side in FIG. 3A) included in the inlet parts 30 and farther from the individual outlet parts 36*a*. The dye and the pigment have, for example, the same color.

The inlet parts 30 are arranged to overlap with the manifold 36 in plan view. That is, the manifold 36 is disposed right below (directly below) the inlet parts 30. Each of the inlet parts 30 communicates with the corresponding one of the upstream-side portions 33 of the manifold 36. That is, the upstream-side portions 33 of the manifold 36 correspond respectively to the inlet parts 30, and different channels are formed by separating one of the upstream-side portions 33 from the other of the upstream-side portions 33 by use of the manifold partitioning wall portion 42. Accordingly, in this embodiment, some regions (i.e., the two upstream-side portions 33) of the manifold 36 are defined or separated by the manifold partitioning wall portion 42.

As depicted in FIG. 2, the manifold partitioning wall portion 42 is formed so that a center portion 42*a* in the left-right direction D2 protrudes downward beyond the remaining portion thereof. In the manifold partitioning wall portion 42, a lower surface of the center portion 42*a* is provided at a position higher than a joining surface between the upstream-side part 31 and the downstream-side part 32. Accordingly, the communication portion 35, through which a lower portion of one of the upstream-side portions 33 communicates with a lower portion of the other of the upstream-side portions 33, is formed in an area at the lower side of the center portion 42*a* of the manifold partitioning wall portion 42. That is, not only the two upstream-side portions 33 as the different channels but also the communication portion 35 as a common channel for the pigment and the dye are formed in the upstream-side part 31 according to this embodiment. The communication portion 35 communicates with the downstream-side portion 34 formed by the downstream-side part 32.

The downstream-side portion 34 communicates with the respective upstream-side portions 33 via the communication portion 35. That is, the downstream-side portion 34 is a common area for the upstream-side portions 33. The downstream-side portion 34 communicates with the individual outlet parts 36*a*. The individual outlet parts 36*a* communicate with the respective liquid supply channels 37 in the pressure chamber-side portion 39. Thus, liquid in the downstream-side portion 34 is dispersedly supplied to the respective liquid supply channels 37 via the individual outlet parts 36*a*.

An opening 43*a* is provided at a portion that is included in the nozzle plate 43 and that is positioned at the lower side of the downstream-side part 32. A damper 45 is formed to cover the opening 43*a* of the nozzle plate 43 from below. The damper 45 is smaller in thickness than the nozzle plate 43. The damper 45 is provided at the lower side of the inlet parts 30. Thus, the pressure of the liquid from the inlet part 30 is absorbed by the damper 45, and then the liquid inflows into the liquid supply channels 37 via the individual outlet parts 36*a*.

In the liquid discharge head 100 having the above configuration, liquid from a tank (not depicted) is supplied to the manifold 36 through the inlet part 30 of the liquid discharge head 100. Liquid from the inlet part 30 is supplied to the individual outlet parts 36*a* through the manifold 36. Then, an area including the manifold 36, the liquid supply channels 37, the pressure chambers 14, and the nozzles 28 is filled with the liquid. In this state, driving voltage is applied to the upper electrode films 24 corresponding to the respective pressure chambers 14 by the lead electrodes 12 based on a driving signal(s) from a driving IC (not depicted). In such a configuration, the piezoelectric body layers 23 contract in a planar direction together with the upper electrode films 24 and the lower electrode film 25 depending on the driving signal(s). This applies discharge pressure, by which liquid is discharged from the nozzles 28, to the pressure chambers 14. Pressure in the pressure chambers 14 is thus increased to discharge liquid droplets from the nozzle holes 28*a* of the nozzles 28.

Figure 4A:
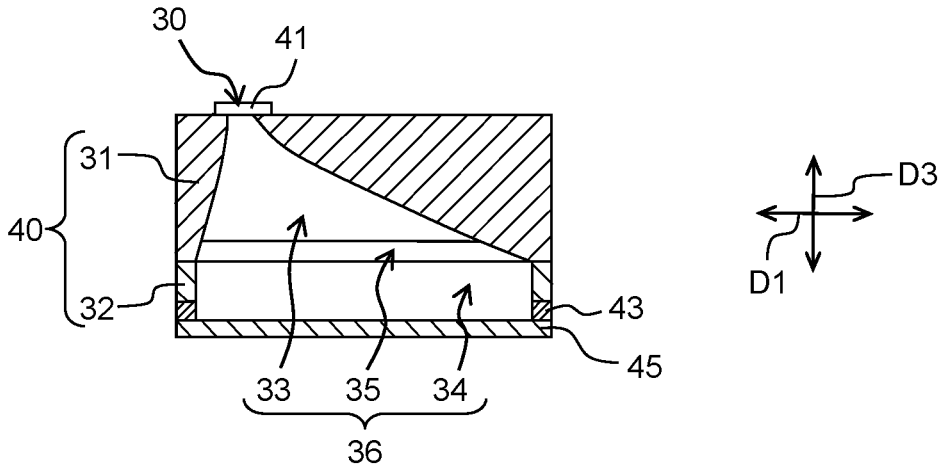
FIG. 4A is a cross-sectional view taken along a line IVA-IVA in FIG. 3A.
Figure 4B:
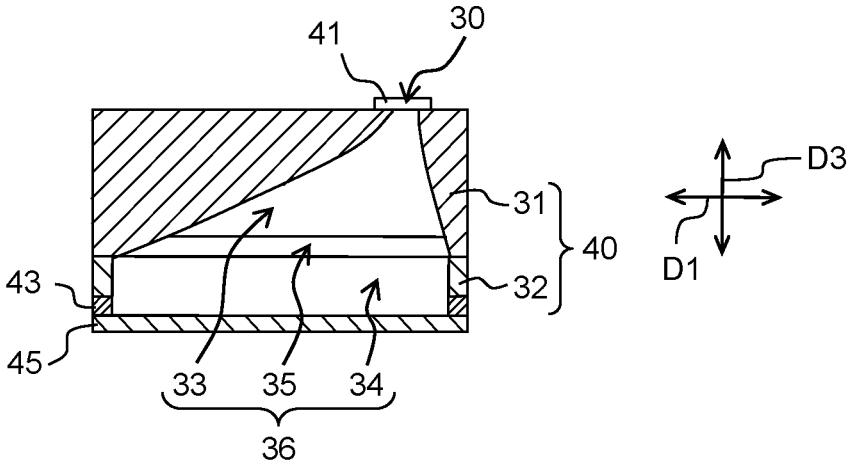
FIG. 4B is a cross-sectional view taken along a line IVB-IVB in FIG. 3A.
Figure 4C:
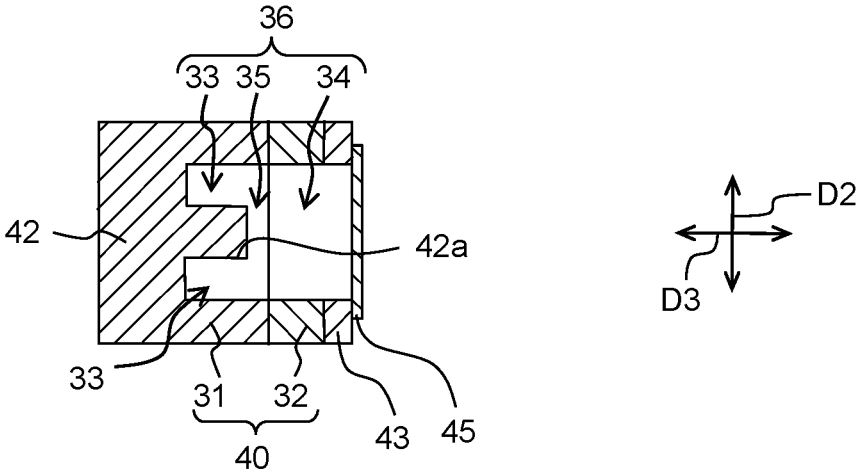
FIG. 4C is a cross-sectional view taken along a line IVC-IVC in FIG. 3A.

Referring to the drawings, a detailed configuration of the manifold-side portion 40 in this embodiment is explained. FIG. 4A is a cross-sectional view taken along a line IVA-IVA in FIG. 3A. FIG. 4B is a cross-sectional view taken along a line IVB-IVB in FIG. 3A. FIG. 4C is a cross-sectional view taken along a line IVC-IVC in FIG. 3A.

As depicted in FIGS. 4A and 4B, an inner space of each inlet part 30 has a shape widening (in diameter) from its upper portion toward its lower portion, for example, flared share (i.e., a circumferential surface defining the inlet has a shape widening in diameter from an inflow side toward an outflow side). Such a widening portion (flared portion) may include, for example, a portion formed into at least one of a tapered shape and an arc shape.

The channel of the upstream-side portion 33 of the manifold 36 includes the portion formed into at least one of the tapered shape and the arc shape. Specifically, the inlet port 30 corresponding to the upstream-side portion 33 depicted in FIG. 4A is disposed at a first side in the front-rear direction D1 (the left side in FIGS. 3A and 4A) as depicted in FIG. 3A. Thus, in the channel of the upstream-side portion 33 depicted in FIG. 4A, its right portion (i.e., an area at the right side of the inlet part 30) extends from the upper side toward the lower side more greatly in the front-rear direction D1 than its left portion (i.e., an area at the left side of the inlet part 30) as viewed in the cross-sectional view of FIG. 4A. On the other hand, the inlet port 30 corresponding to the upstream-side portion 33 in FIG. 4B is disposed at a second side in the front-rear direction D1 (the right side in FIGS. 3A and 4A) as depicted in FIG. 3A. Thus, in the channel of the upstream-side portion 33 depicted in FIG. 4B, its left portion extends from the upper side toward the lower side more greatly in the front-rear direction D1 than its right portion as viewed in the cross-sectional view of FIG. 4B.

In FIGS. 4A and 4B, a maximum length in the front-rear direction D1 of the upstream-side portion 33 is shorter than a maximum length in the front-rear direction D1 of the downstream-side portion 34. In other words, since the maximum length in the front-rear direction D1 of the downstream-side portion 34 is longer than the maximum length in the front-rear direction D1 of the upstream-side portion 33, a level difference (stepped portion) protruding toward the inside of the manifold 36 is prevented from being formed between the upstream-side portion 33 and the downstream-side portion 34. This prevents a situation in which liquid stays at the stepped portion.

An openable and closable valve (two-way valve) 41 is provided for each inlet part 30. The openable and closable valve 41 can switch its position between an open position where the valve 41 allows liquid to flow downstream and a closed position where the flowing of liquid toward the downstream-side is blocked by the valve 41. The openable and closable valve 41 may be configured, for example, by any of a valve using a piezoelectric element, an electromagnetic valve, and a ball valve.

In the above embodiment, a concept or a wording of the inlet part 30 includes a hole (space) and a part (wall) forming or defining the hole. Similarly, a concept or a wording of the individual outlet part 36*a* includes a hole (space) and a part (wall) forming or defining the hole, and a concept or a wording of the manifold 36 includes a hole (space) and a part (wall) forming or defining the hole.

As explained above, in the liquid discharge head 100 of this embodiment, the manifold 36 is formed by the upstream-side portions 33 corresponding to the respective inlet parts 30 and the downstream-side portion 34 that is common to the respective upstream-side portions 33. Thus, there is no need to provide multiple liquid discharge heads corresponding to kinds of liquids to be discharged. This prevents an increase in size of a discharge apparatus including the liquid discharge head 100. Further, since a switching mechanism such as a three-port valve is not required, a configuration for switching liquid supply can be downsized. In a conventional apparatus, a preceding liquid remaining in long channels including a supply channel, a reservoir, and individual channels is required to be drained (discharged) before a following liquid is introduced into the apparatus. However, in the liquid discharge head 100 of this embodiment, the switching of liquid supply can be performed at a side more downstream than the conventional configuration. Thus, a time required for draining (discharging) the residual preceding liquid can be shortened, and following liquid can be introduced into the manifold 36 through the inlet part 30 corresponding thereto immediately after the preceding liquid is discharged. Accordingly, multiple kinds of liquids can be discharged quickly. Further, the switching of liquid supply can be performed at the upstream-side portions 33 of the manifold 36, and thus the liquid channel(s) (i.e., an area(s) where liquid is required to be replaced) can be shorter than that (those) in the conventional apparatus. This makes an amount of the residual liquid in the liquid discharge head 100 of the present disclosure smaller than that in the conventional apparatus. Accordingly, it is possible to make an area where liquids are mixed (color mixture area) small and to reduce a drain amount (discharge amount) of the residual liquid.

In this embodiment, since the inner space of the inlet part 30 has the shape widening (in diameter) from the upper portion toward the lower portion, liquid can inflow thereinto smoothly.

In this embodiment, since the channel forming the upstream-side portion 33 of the manifold 36 includes the portion formed into at least one of the tapered shape and the arc shape. This allows liquid to inflow thereinto smoothly.

In this embodiment, the respective inlet parts 30 are arranged to overlap with the manifold 36 in plan view. In other words, the manifold 36 is disposed directly below the respective inlet parts 30. In this configuration, liquid from the inlet parts 30 inflows into the manifold 36 easily.

In this embodiment, the respective inlet parts 30 are arranged to be shifted from each other in the arrangement direction D1 (direction in which the individual outlet parts 36*a* are arranged). Further, the inlet parts 30 are arranged to be shifted from each other in the left-right direction D2 that is orthogonal to the front-rear direction D1. That is, one of the inlet parts 30 and the other of the inlet parts 30 are arranged at predefined intervals in the front-rear direction D1 and the left-right direction D2. In this configuration, it is possible to easily arrange supply joints for supplying liquids to the respective inlet parts 30.

In this embodiment, the damper 45 is formed at the lower side of the downstream-side part 32. The damper 45 is provided below the inlet parts 30. In this configuration, liquid introduced from each of the inlet parts 30 can be led to the liquid supply channels 37 in a state where the pressure of the liquid introduced from the inlet part 30 is absorbed by the damper 45.

In this embodiment, the openable and closable valves 41 are provided for the respective inlet parts 30. The state where liquid is allowed to flow downstream and the state where the flowing of liquid toward the downstream-side is blocked can be switched by the openable and closable valve 41, that is, by a simple configuration.

In this embodiment, the structure of the openable and closable valve 41 is not complicated by adopting, as the openable and closable 41, any of the valve using the piezoelectric element, the electromagnetic valve, the ball valve, and the like.

In this embodiment, liquids discharged from the liquid discharge head 100 include a pigment, a dye, a pre-treatment agent, and a post-treatment agent. Even in the liquid discharge head 100 from which four kinds of liquids are discharged, it is possible to discharge multiple kinds of liquids quickly as described above.

In this embodiment, it is possible to reduce or prevent the color mixture caused by the dye and the pigment by discharging the dye and the pigment having the same color. Further, even when the dye is mixed with the pigment, the color mixture is inconspicuous, because the dye and the pigment have the same color.

Further, in this embodiment, the pigment as the liquid inflows into one of the inlet parts 30 that is closer to the individual outlet parts 36*a* (the inlet part 30 at the lower side in FIG. 3A). The pigment is typically liable to stagnate in channels. Thus, the pigment is made to inflow into the inlet part 30 closer to the individual outlet parts 36*a* as descried above, shortening the channel lengths ranging from the inlet part 30 to the individual outlet parts 36*a*, compared to a case where the pigment inflows into the inlet part 30 farther from the individual outlet parts 36*a* (inlet part 30 at the upper side in FIG. 3A). Therefore, the pigment is not likely to stagnate in channels in this embodiment.

In this embodiment, the communication portion 35 is provided to allow the lower portion of the upstream-side portion 33 corresponding to one of the inlet parts 30 to communicate with the lower portion of the upstream-side portion 33 corresponding to the other of the inlet parts 30. In this configuration, not only the downstream-side portion 34 but also the communication portion 35 function as the common channel. This makes the volume of the common channel of the liquid large.

In this embodiment, the manifold 36 is formed by integrally joining the upstream-side part 31 that forms the upstream-side portions 33 and the downstream-side part 32 of the channel forming substrate 27 that forms the pressure chambers 14, the liquid supply channels 37, and the downstream-side portion 34. This configuration is simple and makes the volume of the manifold 36 large.

In this embodiment, the maximum length in the front-rear direction D1 of the upstream-side portion 33 is shorter than the maximum length in the front-rear direction D1 of the downstream-side portion 34. Thus, a level difference (stepped portion) protruding toward the inside of the manifold 36 is prevented from being formed between the upstream-side portion 33 and the downstream-side portion 34. This prevents a situation in which liquid stays at the stepped portion, making it possible to supply liquid downward smoothly.

Second Embodiment

A liquid discharge head according to a second embodiment is described below. Although the two inlet parts 30 are provided in the liquid discharge head 100 of the first embodiment, three inlet parts (that is, two inlet parts 30 and one cleaner inlet part 30A) are provided in a liquid discharge head of the second embodiment. The constitutive parts or components, which are the same as or equivalent to those of the first embodiment, are designated by the same reference numerals, any explanation therefor is omitted as appropriate.

Figure 5A:
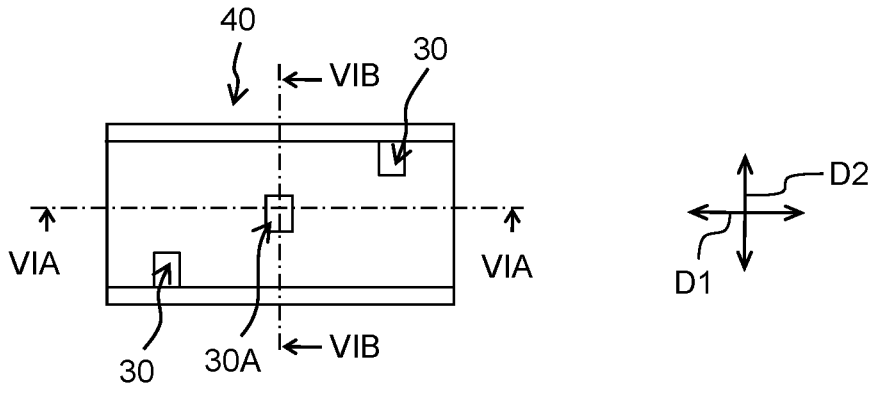
FIG. 5A is a plan view of a modification of the manifold-side portion in FIG. 3A.
Figure 5B:
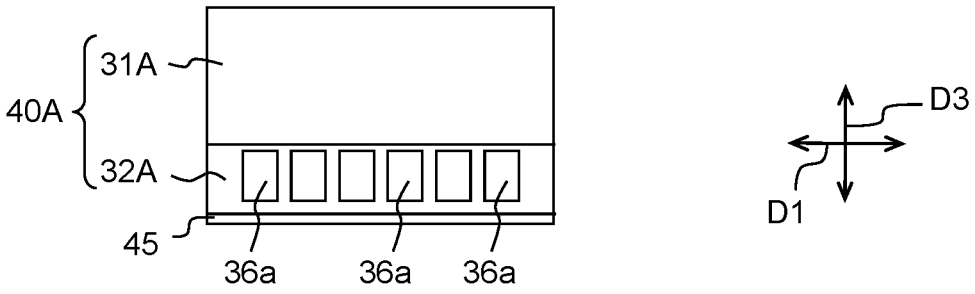
FIG. 5B is a side view of the manifold-side portion in FIG. 5A.

As described in FIG. 5B, similar to the first embodiment, a manifold-side portion 40A of this embodiment includes an upstream-side part 31A and a downstream-side part 32A. In the manifold-side portion 40A of the second embodiment as depicted in FIG. 5A, an upper portion of the upstream-side part 31A is provided with the two inlet parts 30 and a cleaner inlet part 30A. Also in the second embodiment, the inlet parts 30 are arranged to be shifted from each other in the front-rear direction D1. Further, the inlet parts 30 are arranged to be shifted from each other in the left-right direction D2. The cleaner inlet part 30A is positioned between one of the inlet parts 30 and the other of the inlet parts 30 in the front-rear direction D1 and the left-right direction D2. In this configuration, each of the inlet parts 30 and the cleaner inlet part 30A adjacent to each other are arranged at predefined intervals in the front-rear direction D1 and the left-right direction D2.

In the second embodiment, the inlet parts 30 and the cleaner inlet part 30A are provided corresponding respectively to three kinds of liquids. Specifically, for example, a pigment as the liquid inflows into the inlet part 30 at a first side in the front-rear direction D1 (left side in FIG. 5A), and a dye as the liquid inflows into the inlet part 30 at a second side in the front-rear direction D1 (right side in FIG. 5A). Further, a cleaner as the liquid inflows into the cleaner inlet part 30A. Similar to the first embodiment, the dye and the pigment may have the same color in the second embodiment.

The inlet parts 30 are arranged to overlap with the manifold 36 in plan view. That is, the manifold 36 is disposed directly below the inlet parts 30. Here, the inlet part 30 at the first side in the front-rear direction D1 and the inlet part 30 at the second side in the front-rear direction D1 communicate with the corresponding upstream-side portions 33 of the manifold 36, respectively. Meanwhile, as depicted in FIG. 6B, a manifold partitioning wall portion 50 defines the upstream-side portion 33 at the left side in the left-right direction D2 communicating with the inlet part 30 at the first side in the front-rear direction D1 and the upstream-side portion 33 at the right side in the left-right direction D2 communicating with the inlet part 30 at the second side in the front-rear direction D1. Although the manifold partitioning wall portion 50 is similar in shape to the manifold partitioning wall portion 42 in the first embodiment, the manifold partitioning wall portion 50 is different from the manifold partitioning wall portion 42 in that a through hole part 51 extending in the up-down direction D3 in FIG. 6B is formed at the center in the left-right direction D2 of the manifold partitioning wall portion 50. An upper end of the through hole part 51 communicates with the cleaner inlet part 30A disposed at the center in the front-rear direction D1 as described above. Thus, liquid from the cleaner inlet part 30A disposed at the center flows through the through hole part 51 and then inflows into the communication portion 35 of the manifold 36.

Referring to the drawings, a detailed configuration of the manifold-side portion 40A of the second embodiment is explained.

Figure 6A:
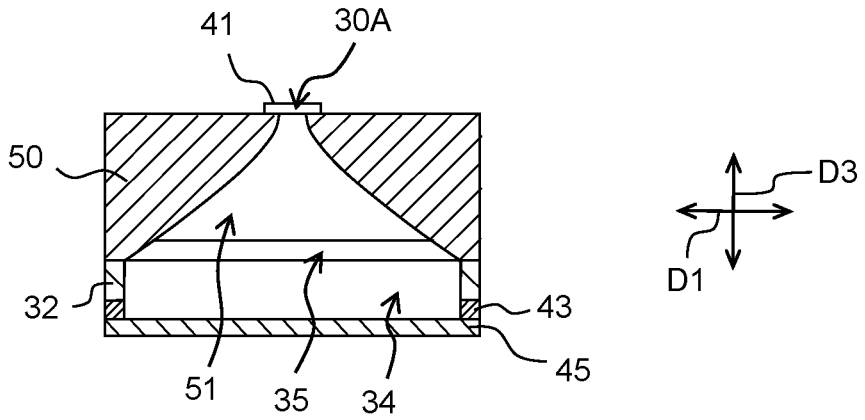
FIG. 6A is a cross-sectional view taken along a line VIA-VIA in FIG. 5A.
Figure 6B:
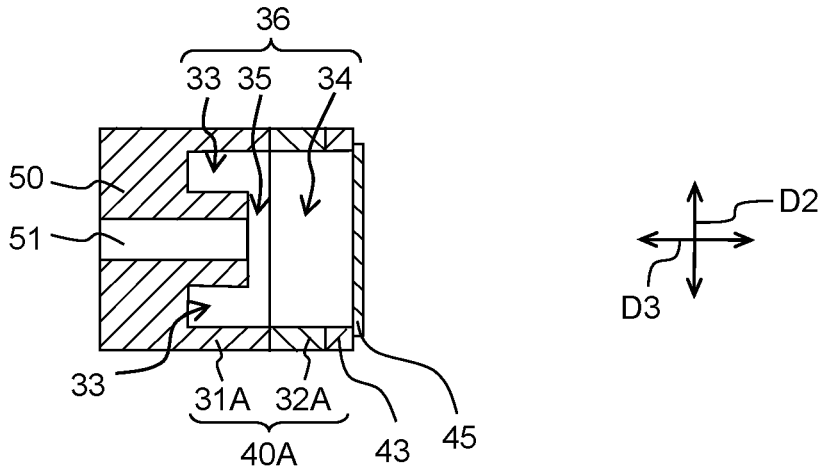
FIG. 6B is a cross-sectional view taken along a line VIB-VIB in FIG. 5A.

As depicted in FIG. 6A, a channel forming the through hole part 51 that communicates with the cleaner inlet part 30A extends symmetrically in the front-rear direction D1 from the upper side toward the lower side in planar view so that a length in the front-rear direction D1 of a lower portion of the channel is longer than a length in the front-rear direction D1 of an upper portion of the channel. The shape of the upstream-side portion 33 (the shape of the upstream-side part 31) that communicates with the inlet part 30 at the first side in the front-rear direction D1 (left side in FIG. 5A) is the same as the shape of the upstream-side portion 33 (the shape of the upstream-side part 31) of the first embodiment (see FIG. 4A). The shape of the upstream-side portion 33 (the shape of the upstream-side part 31) that communicates with the inlet part 30 at the second side in the front-rear direction D1 (right side in FIG. 5A) is the same as the shape of the upstream-side portion 33 (the shape of the upstream-side part 31) in the first embodiment (see FIG. 4B).

A maximum length in the front-rear direction D1 of the through hole part 51 depicted in FIG. 6A is shorter than a maximum length in the front-rear direction D1 of the downstream-side portion 34. In other words, since the maximum length in the front-rear direction D1 of the downstream-side portion 34 is longer than the maximum length in the front-rear direction D1 of the through hole part 51, a level difference (stepped portion) protruding toward the inside of the manifold 36 is prevented from being formed between the through hole part 51 and the downstream-side portion 34. This prevents a situation in which liquid stays at the stepped portion.

In the second embodiment, a concept or a wording of the through hole part 51 includes a hole (space) and a part (wall) forming or defining the hole.

Thus, similar to the first embodiment, an increase in size of a discharge apparatus including the liquid discharge head 100 of the second embodiment is inhibited. Further, similar to the first embodiment, it is possible to discharge multiple kinds of liquids quickly and to downsize the configuration for switching the liquid supply. Furthermore, similar to the first embodiment, an amount of the residual liquid in the second embodiment is smaller than that in the conventional apparatus. It is thus possible to make an area where liquids are mixed (color mixture area) small and to reduce a drain amount (discharge amount) of residual liquid.

In the second embodiment, since the cleaner can inflow into the cleaner inlet part 30A, it is possible to quickly clean portions of the manifold 36 (in particular, the communication portion 35 and the downstream-side portion 34). Further, since the cleaner inlet part 30A is disposed between the inlet part 30 at the left side and the inlet part 30 at the right side, it is possible to supply the cleaner over the whole of the manifold 36 in the front-rear direction D1. Accordingly, it is possible to clean the communication portion 35 and the downstream-side portion 34 quickly.

Other Embodiments

The present invention is not limited to the embodiments described above, and the present invention can be variously modified within a range without deviating from the gist or essential characteristics of the present invention. The modification can be made, for example, as follows.

In the above embodiment(s), the manifold 36 is formed by integrally joining the upstream-side part 31 that forms the upstream-side portions 33 and the communication portion 35 and the downstream-side part 32 that forms the downstream-side portion 34. The present disclosure, however, is not limited thereto. The manifold 36 may be formed by one component or part.

In the above embodiment(s), the configuration in which the damper 45, which is a member different from the nozzle plate 43, is disposed below the inlet parts 30, is adopted. However, it is not limited thereto. For example, the damper 45 may be formed by performing, for example, half-etching on the nozzle plate 43.

In the above embodiment, the manifold partitioning wall portion 42 is formed by one component. However, it is not limited thereto. The manifold partitioning wall portion 42 may be formed by joining two components that are divided at the center in the left-right direction D2.

In the above embodiment(s), the intervals between the inlet parts 30 (the interval in the front-rear direction D1 and the interval in the left-right direction D2) are regular intervals. However, it is not limited thereto. One or both of the intervals in the front-rear direction D1 and the left-right direction D2 may not be the regular interval(s).

In the above embodiment(s), the internal space of each inlet part 30 has the shape widening (in diameter) from its upper portion toward its lower portion. However, it is not limited thereto. The internal space of each inlet part 30 may have, for example, a straight shape in which the upper portion and the lower portion have the same diameter.

In the above embodiment(s), the communication portion 35 is formed between the upstream-side portion 33 and the downstream-side portion 34 by providing the manifold partitioning wall portion 42 so that the lower surface of the center portion of the manifold partitioning wall portion 42 is positioned at the position higher than the joining surface between the upstream-side part 31 and the downstream-side part 32. However, it is not indispensable to provide the communication portion 35.

In the above embodiment(s), the two or three inlets (inlet parts 30 and cleaner inlet part 30A) are provided to allow multiple kinds of liquids to flow therethrough. However, it is not limited thereto. Four or more inlets may be provided.

In the above embodiment(s), the cleaner as the liquid inflows into the cleaner inlet part 30A. The present disclosure, however, is not limited thereto. For example, any other liquid such as a pre-treatment agent and a post-treatment agent may inflow into the cleaner inlet part 30A.

What is claimed is:

1. A liquid discharge head, comprising:

a plurality of inlet parts provided corresponding to a plurality of kinds of liquids;

a plurality of pressure chambers in which discharge pressure is applied to the liquids;

a plurality of individual outlet parts through which the liquids are supplied to the plurality of pressure chambers; and a manifold which communicates with the plurality of inlet parts, and through which the liquids from the plurality of inlet parts are supplied to the plurality of individual outlet parts, wherein the manifold includes:

a plurality of upstream-side portions in each of which a channel corresponding to one of the plurality of inlet parts is defined, and a downstream-side portion which communicates with the plurality of upstream-side portions, and in which a channel communicating with the plurality of individual outlet parts is defined.

2. The liquid discharge head according to claim 1, wherein an internal space of each of the plurality of inlet parts has a shape widening from an upper portion of the internal space toward a lower portion of the internal space.

3. The liquid discharge head according to claim 1, wherein the channel defined in each of the plurality of upstream-side portions of the manifold includes a portion having at least one of a tapered shape and an arc shape.

4. The liquid discharge head according to claim 1, wherein the plurality of inlet parts is arranged to overlap with the manifold in plan view.

5. The liquid discharge head according to claim 1, wherein the plurality of inlet parts is arranged to be shifted from each other in an arrangement direction in which the plurality of individual outlet parts is arranged.

6. The liquid discharge head according to claim 1, wherein the plurality of inlet parts is arranged to be shifted from each other in a direction orthogonal to an arrangement direction in which the plurality of individual outlet parts is arranged.

7. The liquid discharge head according to claim 1, further comprising a damper that is thin and is disposed below the plurality of inlet parts.

8. The liquid discharge head according to claim 1, wherein each of the plurality of inlet parts is provided with a two-way valve configured to be switched between an open position where the valve allows each of the liquids to flow downstream and a closed position where the valve blocks downstream flowing of each of the liquids.

9. The liquid discharge head according to claim 8, wherein the valve is any of a valve using a piezoelectric element, an electromagnetic valve, and a ball valve.

10. The liquid discharge head according to claim 1, wherein the plurality of kinds of liquids includes at least two of a pigment, a dye, a pre-treatment agent, and a post-treatment agent.

11. The liquid discharge head according to claim 10, wherein a color of the dye and a color of the pigment are identical to each other.

12. The liquid discharge head according to claim 1, wherein the plurality of individual outlet parts are provided in a side surface, of the manifold, at one side in a short-side direction of the manifold, and a pigment as one of the liquids inflows into an inlet part, of the plurality of inlet parts, closer to the plurality of individual outlet parts than a remaining inlet part of the plurality of inlet parts.

13. The liquid discharge head according to claim 1, further comprising a communication portion communicating with a lower portion of one of the plurality of upstream-side portions corresponding to one of the plurality of inlet parts through which a pigment as one of the liquids inflows and a lower portion of one of the plurality of upstream-side portions corresponding to one of the plurality of inlet parts through which a dye as one of the liquids inflows.

14. The liquid discharge head according to claim 1, wherein the manifold is formed by integrally joining an upstream-side structure forming the plurality of upstream-side portions and a downstream-side structure forming the downstream-side portion.

15. The liquid discharge head according to claim 1, wherein a maximum length of each of the plurality of upstream-side portions in an arrangement direction in which the plurality of individual outlet parts is arranged is shorter than a maximum length of the downstream portion in the arrangement direction.

16. The liquid discharge head according to claim 1, further comprising a cleaner inlet part connected to the manifold, the cleaner inlet part being an inlet part through which a cleaner inflows into the manifold.

17. The liquid discharge head according to claim 16, wherein the cleaner inlet part is disposed between inlet parts, of the plurality of inlet parts, arranged in a longitudinal direction of the manifold.

18. The liquid discharge head according to claim 1, wherein the plurality of upstream-side portions include a first upstream-side portion and a second upstream-side portion each extending in an extending direction of the manifold, and the first and second upstream-side portions are separated from each other by a wall extending in the extending direction of the manifold.

19. The liquid discharge head according to claim 18, wherein a surface defining a top portion of the first upstream-side portion is inclined downward with distance from corresponding one of the plurality of inlet parts, and a surface defining a top portion of the second upstream-side portion is inclined downward with distance from corresponding one of the plurality of inlet parts.

* * * * *